US005237776A

United States Patent [19]

Kubota

[11] Patent Number: 5,237,776

[45] Date of Patent: Aug. 24, 1993

[54] SEALING DEVICES FOR DOORS

[75] Inventor: Kenichi Kubota, Sabae, Japan

[73] Assignees: Tokyo Shutter Co., Ltd., Fukui; Nichimen Corporation, Osaka, both of Japan

[21] Appl. No.: 852,862

[22] Filed: Mar. 17, 1992

[30] Foreign Application Priority Data

Apr. 19, 1991 [JP] Japan ..... 3-117047
Oct. 12, 1991 [JP] Japan ..... 3-091459

[51] Int. Cl.[5] ..... E06B 7/28
[52] U.S. Cl. ..... 49/319; 49/321
[58] Field of Search ..... 49/319, 321, 411, 475, 49/478; 160/40, 199, 206

[56] References Cited

U.S. PATENT DOCUMENTS

| | | | |
|---|---|---|---|
| 2,114,198 | 4/1938 | Winn | 160/199 X |
| 2,131,100 | 9/1938 | Fauner | 49/319 |
| 2,837,151 | 6/1958 | Stroup | 49/321 X |
| 2,876,506 | 3/1959 | Knebel | 49/319 |
| 3,073,381 | 1/1965 | Burmeister | 160/199 X |
| 3,295,257 | 1/1967 | Douglass | 160/40 X |
| 3,295,588 | 1/1967 | Gilson | 160/40 X |
| 4,009,537 | 3/1977 | Hubbard | 49/319 |

FOREIGN PATENT DOCUMENTS 452191 2/1990 Japan .

*Primary Examiner*—Peter M. Cuomo
*Assistant Examiner*—Jerry Redman
*Attorney, Agent, or Firm*—Shlesinger Arkwright & Garvey

[57] ABSTRACT

A sealing device for movable panels such as doors, windows or the like, the panels being supported by rails and comprising a pivoting member extending from the support rail, the pivoting member has first and second ends and is rotatable between a normal horizontal position and an engagible vertical position. A weighted member is attached to the first end for maintaining the pivoting member in the normal horizontal position. A sealing member extends from the second end, the sealing member is engagible against a side of the panel to seal the same only when the pivoting member is in the vertical position. The pivoting member is only movable and maintainable in the engaged vertical position by a retractable actuator means capable of applying a sufficient force to move the weighted member and maintain the pivoting member in the engaged vertical position.

6 Claims, 5 Drawing Sheets

SEALING DEVICES FOR DOORS

BACKGROUND OF THE INVENTION

This invention relates to sealing devices for folding doors or windows consisting of a plurality of panels. The sealing devices made in accordance with this invention can positively hermetically and in noise-proof manner seal the upper and lower ends of the doors or windows against rain and wind once they are closed.

Folding doors and windows of the type mentioned above generally comprise a plurality of panels which are foldably connected to each other. They are generally hung by their upper rails, and each of the lateral sides of the panels are provided with vertically extending guide plates. The ends of such guide plates have at their inner sides thereof sealing members of soft and resilient materials such as rubber, sponge, felt or the like which extend so as to reach upper ends of the panels. The sealing members or materials keep the upper ends of the folding door air-tight against the frame while preventing the door from chattering when pressed against.

The guide plates cannot however, extended along the entire length or width or the door, and must therefore have portions thereof cut out so that they will not hinder the free swiveling movement of panels during folding. The portions of the guide plates which have been thus cut out, produce openings between the panels and their guide rails, thereby spoiling the hermetical seal of the door.

Japanese Utility Model Application Hei-2 No. 94517 suggests a device for solving the drawbacks of the conventional guide plates mentioned above. To the inside of a part of a guide plate where a cut out has been made, there is pivotally fitted an additional guide piece provided with sealing materials, while to upper portions of panels there is fitted retainers for detecting the guide piece. When the door is to be folded, the additional guide piece rotates upwardly, as it is forced by the retainers. On the other hand, when the door is closed, the additional guide piece hangs down, and is released from the retainers. Thus, the folding and closing of the door will not be interfered with by the additional guide piece.

In such prior art sealing devices, the outer appearance of the door is spoiled since the retainers for the additional guide piece are fitted outwardly to the upper portions of the panels. Also, since the retainers are fitted to the panels, the additional guide piece cannot be held stable unless the panels are maintained absolutely stable.

OBJECTS AND SUMMARY OF THE INVENTION

The object of this invention is therefore to provide a unique and absolutely stable sealing device for doors an windows, which comprises one or more supplementary guide plates that are normally kept outside of the range of movements of panels so that the panels may be folded and stretched freely while allowing the guide plates to be swiveled above the panels solely by themselves and without any other assistance, such as, for example, by retainers employed in the aforementioned prior art.

Another object of this invention is to provide a unique sealing device in which the supplementary guide plates may be operated independently whether or not the door is stretched and whereby the panels which have been stretched are maintained stable thereby providing excellent air-tightness, water-tightness, and noiseproofness.

A further object of this invention is to provide a sealing device which can be employed at the upper and lower parts of the door or window and which can be of the folding, sliding, or hinged type.

Although a sealing device for folding doors or the like made in accordance with this invention employs supplementary guide plates which are pivotally and rotatably fitted to cut-out portions of a guide plate extending downwardly from an upper rail, each supplementary guide plates according to he present invention further comprises a driving portion or member which acts as a weight and a sealing portion or member fitted at its inner side with sealing materials characterized in that the plate as a whole is normally kept, by the operation of the weight working upon the driving portion, horizontally at a released position.

The supplementary guide plate is operable according to the present invention, by a locking mechanism provided for the foldable panels. The locking mechanisms which acts to hold the panels unfoldable once actuated includes a locking member which is protrusible from an upper end of the panel or joint frame connecting the panels in which the locking mechanisms are vertically accommodated, and when the locking member is projected upwardly from the panels which are closed or stretched, acts to lift the weighted driving portion of the supplementary guide plate upwardly thereby rotating it so as to have its sealing portion closely abutted against the upper outer part of the panel. In this invention, besides the locking mechanisms there may also be provided a rod or rods which are exclusively for lifting the supplementary guide plate and which can be operated independently of the locking mechanisms.

In the present invention, means for operating the locking mechanisms and manners by which the supplementary guide plate are fitted to the upper rail are not restricted to a particular design. Accordingly, the entire length of either side or each sides of the upper and/or lower rails may be armored solely with the supplementary guide plate. It is also within the scope of the present to provide the supplementary guide plate only to cut-out portions of a guide plate hanging from the rail. Locations of the supplementary guide plate of the present invention will accordingly be determined selectively in accordance with the general arrangement of the folding systems of the door.

The sealing devices made in accordance with this invention are employable for various space-closing and opening gears which include not only folding doors and windows but also sliding and hinged doors and windows. They might be fitted to not only the upper rails or lintels but to lower rails or lintels as well.

DETAILED DESCRIPTION OF THE PREFERRED EMBODIMENT

Figure 1:
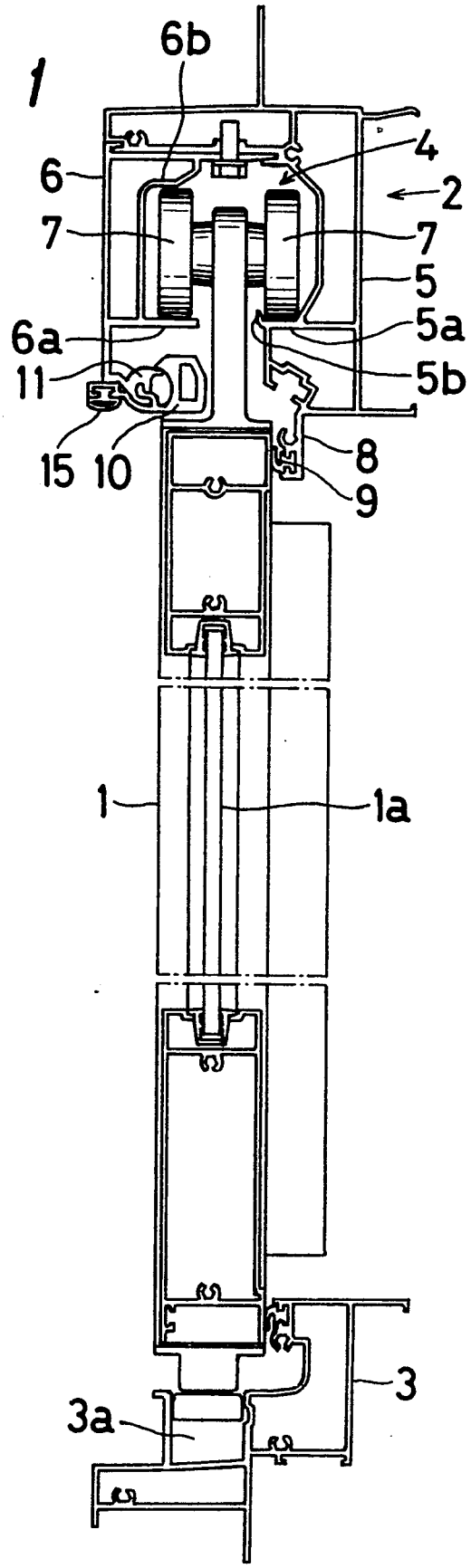
FIG 1 illustrates a vertical cross-sectional view of a folding door employing the sealing devices made in accordance with this invention.

The sealing devices for doors and windows made in accordance with this invention are further explained by the following examples which are shown in the drawing.

FIG. 1 shows a vertical cross-sectional view of a folding door provided with the sealing devices made in accordance with this invention having its left side outdoors, while its right side is indoors. The overall structures shown will be substantially the same as in case of a folding window, although their dimensions may be different. Numeral 1 indicates a panel, the outer frames of which is made of metal such as aluminum, and the central portion of which is fitted for example with transparent glass sheets 1*a*. 2 indicates an upper rail fitted to an upper lintel of the door opening, and 3*a* a lower rail fitted to a lower lintel respectively made of aluminum or the like. The panels 1 are hung by a runner 4. Although the upper rail 2 can be of any configuration in the present invention, the rail employed in the present example consists of a two piece interlocking design which is splitable. That is, it is made from a stationary rail 5 and another rail 6 which is insertedly fitted to the former rail. The stationary rail 5 is formed at its inner edge with a path 5*a* having an upstanding flange 5*b*, while the rail 6 has no such flange at its path 6*a*. Instead, the rail 6 is provided with an upper bent portion 6*b* which makes close contact to one of rollers 7 of the runner 4 so that the rollers 4 can move along the rails smoothly without chattering and in a manner such that they shall not be derailed.

In order to keep the panel 1 air-tight at its upper portion, a guide plate 8 extends downwardly from the stationary rail 5. The guide plate 8 is lined all along its inner side by resilient sealing materials 9 which abuts against the upper portion of the panel 1. At an opposite side facing guide plate 8 with the panel 1 therebetween there is provided a supplemental guide piece or plate 10 which is pivotally and rotatably fitted to a shaft 11 projecting horizontally inwardly from a lower edge of the rail 6.

Figure 3A:
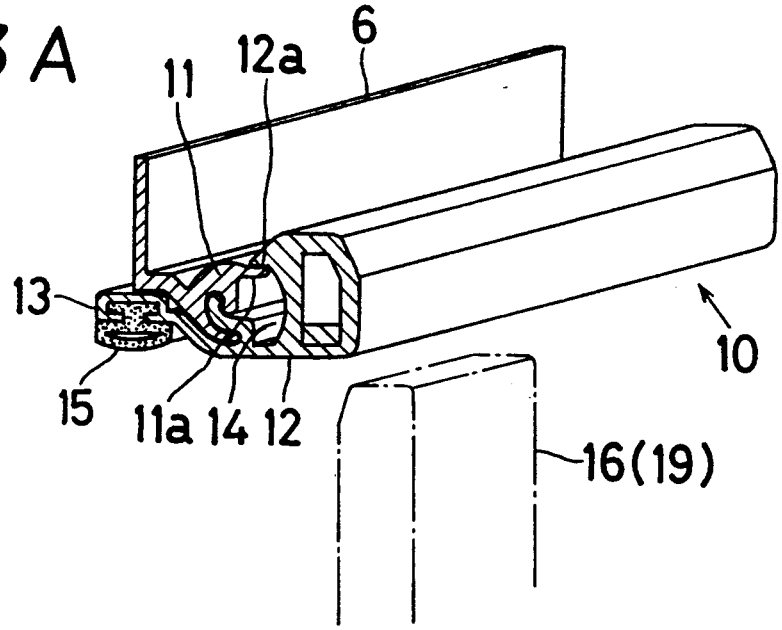
FIG. 3A through 3C are perspective views illustrating the swiveling movements of the supplementary guide plate from its normal position to its operative position.
Figure 3B:
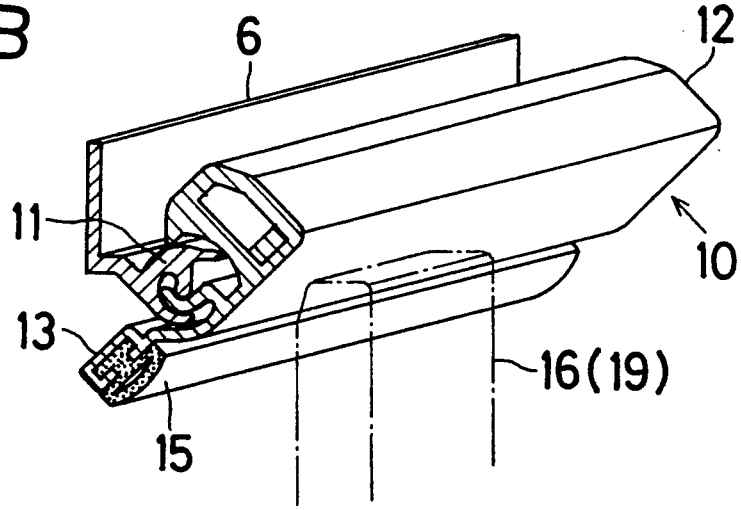
Figure 3C:
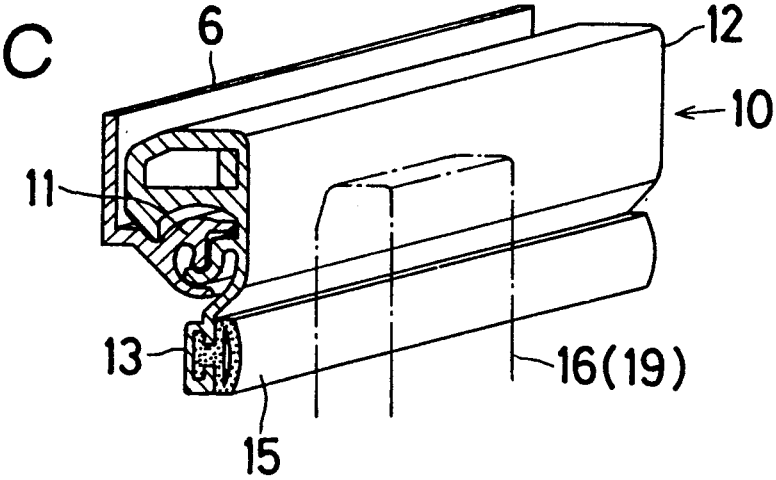

In FIGS. 3A to 3C, structure and operation of the supplementary guide plate 10 is shown. The guide plate 10 consists of an inner driving portion or member 12 and an outer sealing portion or member 13 each of which are integral with each other, and further include a journal portion or member 14 formed at its middle part. The journal 14 is insertedly and unremovably supported by the shaft 11 so that the guide plate 10 as a whole can swivel about the shaft 11 to a determined angle such as about 90°

The driving portion 12 acts as a weight which is far heavier than the sealing portion 13. Since the two portions are unbalanced in weight, the supplementary guide plate 10 as a whole is normally urged to the horizontal, as shown in FIG. 3A. It should be noted that the driving portion 12 cannot be swiveled downwardly from its horizontal position, since front edge 12*a* is kept abutted against upper front edge 11*a* of the shaft 11, while the outer lateral surface of the sealing portion 13 abuts against the lower surface of the rail 6 so as to prevent the sealing portion from swiveling upwardly. Thus, the driving portion does not hang downwardly.

A small opening is provided between the horizontally kept supplementary guide plate 10 and the upper end of the panel 1, as best shown in FIG. 1, so that the upper end will not strike against the supplementary guide plate 10 even when the panel 1 is folded outwardly from the upper rail 2.

Although the principal guide plate 8 provided at the side of the stationary rail 5 may extend the full horizontal length of the rail 2, the supplementary guide piece or plate 10 at the side of the removal rail 6 shall not necessarily extend the full length. The plate 10 can be restricted to those areas where the panel 1 is intended to be folded. Generally it is positioned adjacent to one side of a front door opening. That is, the guide plate 8 is provided along the inner and outer sides of the rail 2 except at portions thereof where the supplementary guide 10 is located. In other words, the supplementary guide may be restricted to those locations which face the cut-out portions of the guide plate 8.

When the supplementary guide piece 10 provided at the cut-out portion (not shown) of the guide plate 8 is kept horizontal, it cannot adequately seal up the door, since an opening is created between it and the upper end of the panel 1 positioned at the above-mentioned cut out portion. However, once the driving portion 12 of the supplementary guide plate is lifted up as shown in FIG. 3B, by projecting an upper locking member 16, upwardly from the upper end of the panel or a joint member (not shown) the supplementary guide plate 10 will rotate counter-clockwise and stand up at a right angle as best shown in FIG. 3C, whereby the resilient sealing materials 15 will closely abut against the upper outer part of the panel 1. The door is thus sealed up air-tight, even at the cut-out portion of the principal guide plate 8.

Figure 2:
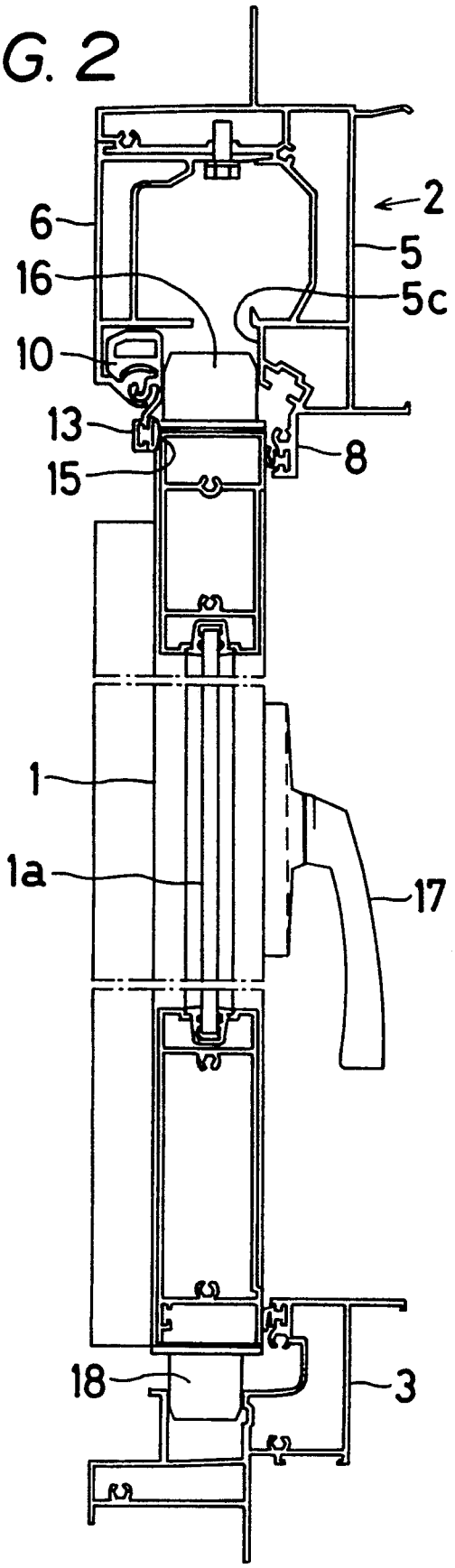
FIG. 2 is similar to that shown in FIG. 1, and further illustrating a supplementary guide piece or plate constituting the sealing devices being brought to an operative position from its normal nonoperative horizontal position.

In FIG. 2, there is shown an upper locking member 16 protruding outwardly from the top end of the joint member connecting an adjoining pair of the panels. The supplementary guide piece 10 has accordingly been rotated and brought to stand up substantially at a right angle. The projected upper locking member 16 is insertedly received between downwardly extending flange 5C of stationary rail 5 and upstanding supplementary guide plate 10 allowing the panels to become unfoldable, with locking member 16 slidable along the rail 2.

When the locking member 16 is retracted so a to make the panels foldable, the sealing material 15 which was abutted against panel is released from restriction causing the supplementary guide plate 10 to be rotated clockwise, whereby the weight of driving portion 12 causes return of the plate 10 to its normal horizontal position.

Although a variety of structures for protruding and retracting the upper locking member 16 are within the scope of the present invention, a specific example thereof is shown in the drawing of FIG. 2. The protrusion and retraction of the member 16 is caused by the manipulation of a handle 17 fitted to an outside wall of the joint member of the panels 1. This handle may be utilized not only for protruding and retracting the upper locking short rod 16 but also for protruding and retracting in association with the movement of the rod 16 a lower locking member 18 made from a short rod which is fitted to lower end of the panel joint member. When the upper and lower locking members are received respectively by the upper and lower rails 2, 3, the panels 1 may more positively be sustained at upper and lower ends thereof so that they will not chatter.

In the majority of folding doors, the supplementary guide plate 10 will only be provided at once of the ends of the upper rail 2 so that the panels are foldable only at a single side. However, in a folding door consisted of several door units, each of which is made of a plurality of panels, it might be advantageous to make the door foldable at several points or sides of the door opening. In this instance, there would be provided the supplementary guide plates 10 having a number corresponding to the member of said units and having a width corresponding to a length of each of said units.

The supplementary guide plate 10 made in accordance with this invention can also be provided for a sliding door. Although the sliding door cannot be folded transversely to its lintel rail, the supplementary guide plate may be actuated in response to the protrusion of the locking members 16, 18 only when the door is closed so as to make the guide plate rotate and stand up thereby making the sealing portion 13 closely abut against the outer surface of the door and in a manner similar to the aforementioned folding door.

A supplementary guide plate 10 having the same structures as the above-mentioned plate can also be provided for the lower rail 3. In this instance the lower locking member 18 is operated by a handle 17 so as to actuate member 18 and rotate the guide plate (not shown) provided for the lower rail 3. As in the previous instance, the plate 10 operates in a similar manner. It is noted however that in this embodiment a weight is provided onto the side of the sealing portion 13 having the sealing materials 15.

In the present embodiment the supplementary guide plates 10 are pivotally and rotatably fitted at locations so that the guide plates 10 for the upper and/or lower rails 2, 3 are cut-out and operated by the locking members 16, 18 which are protrusible from the upper and/or lower ends of the folding door. The present embodiment does not present any inconvenience when all of the panels are stretched or folded simultaneously. However, when only some of the panels are stretched or folded, certain inconvenience is expected.

To wit, when the panels are stretched and closed, the supplementary guide plate 10 is also closed off also by the protruding the locking member, and therefore individual panels cannot be opened.

This inconvenience can be avoided if a plurality of the supplementary guide plates 10 are provided at locations where the panels are intended to be folded independently each other. That is, once the groups or units of the panels are folded and are ready to be installed to a side of a door opening, a first group of panels located adjacent to the side can be folded at that side, and succeeding groups can also be folded where they are once their locking members 16 have been retracted and moved to the side. However, once the succeeding groups are slided towards the side they become stretched and since their locking members are kept protruded, they cannot be folded at the side since the protruded locking members will strike against the supplementary guide plate 10 at the side which has been returned to a horizontal position. It is also difficult to slide the panel smoothly since its surface abuts against the sealing materials 15 which has been brought into an operative position by the protruded locking member 16.

Figure 4:
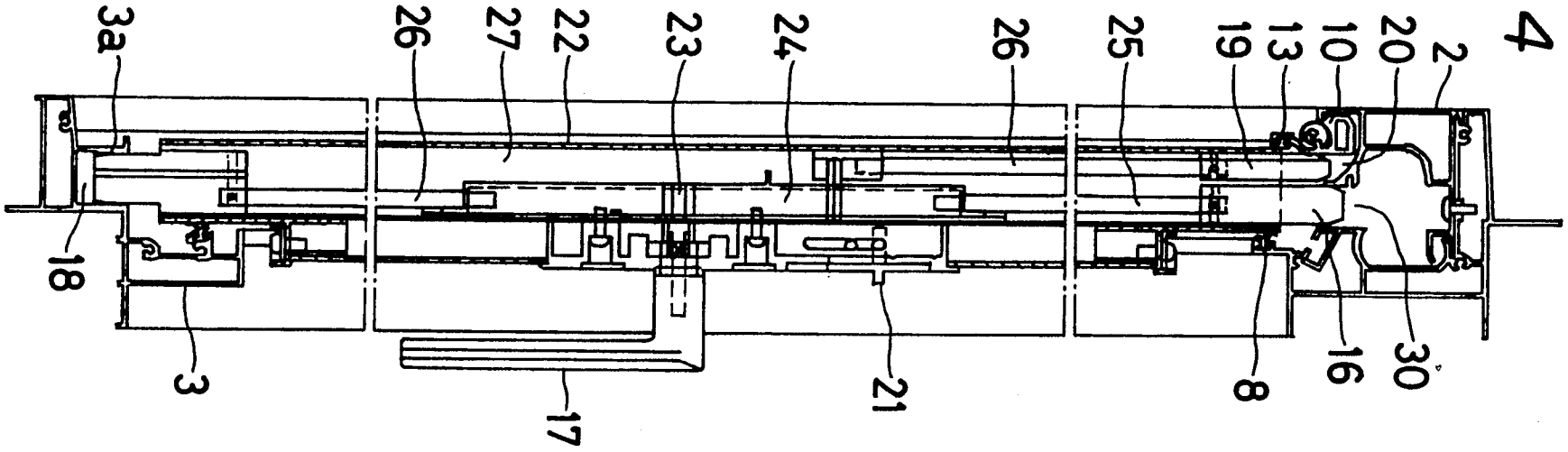
FIG. 4 is similar to that shown in FIG. 1, and further the supplementary guide plate operatable by an independent-actuating means.
Figure 5:
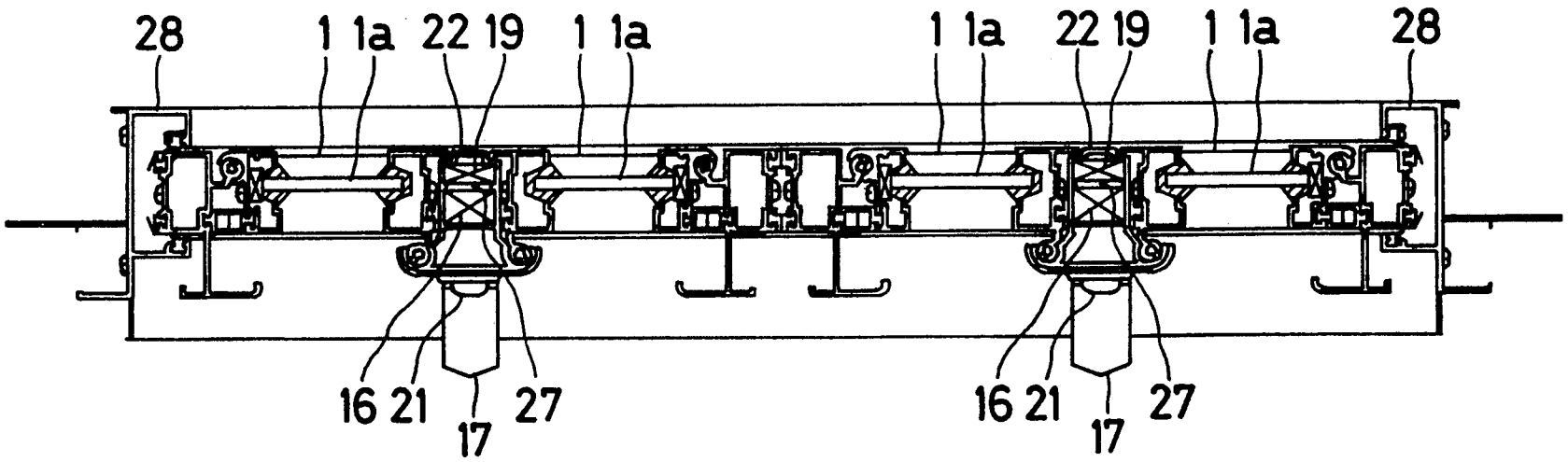
FIG. 5 is a cross-sectional plan view of the folding door according to the present invention provided with the independent actuating means shown in FIG. 4 and consisting of two groups or units each having a pair of panels.

In order to eliminate the above-mentioned inconvenience, an aftermath embodiment is provided showing means which manipulate the supplementary guide plate as illustrated in FIGS. 4 and 5.

In this example, independent to the locking member 16 there is provided a rod designed exclusively for lifting the supplementary guide plate 10 which is normally kept horizontal.

In FIG. 4, the rod indicated by the numeral 19, is located more adjacent to the supplementary guide plate 10 than to the locking member 16. The lifting rod 19 is protrusible into a groove 20 which is separate from a groove 30 to which the locking member 16 is protrusible. The upper and lower locking members 16, 18 are inserted into the upper and lower rails 2, 3 through the rotary manipulation of the handle 17 provided for the joint member 22 connecting the panels 1. The lifting rod 18 is protrusible into the upper rail 2 by the upward movement of a slider 21 provided to the joint member 22 and at a location higher than the location where the handle 17 is provided, while the rod is made protrusible into the lower rail 3 when the supplementary guide plate 10 is provided to the lower rail.

The handle 17 is pivotally fitted to the joint member 22, and the journal of the handle has fitted a pinion 23 which is geared with a pair of racks 24 facing against each other with the pinion therebetween. Thus, when the racks 24 slides upwardly or downwardly with the rotation of the pinion 23, the locking members 16, 18 which are connected to the racks by connecting rods 25 are simultaneously protruded or retracted by manipulation of the handle 17.

On the other hand, the slider 21 is fitted to the joint member or frame 22 so as to be slidable upwardly or downwardly, and works to lift the lifting rod 19 upwardly for projecting it outwardly from the upper end of the frame 22.

In FIG. 5, there is shown the folding door which is made in accordance with the present invention and which consists of two groups or units of panels 1. As best shown in the drawing, the upper and lower locking members 16, 18, lifting rod 19, and their driving and driven mechanisms are all accommodated within square chambers of the panel connecting frames 22. As clearly shown in FIGS. 4 and 5, the locking members 16, 18 and the lifting rod 19 are located independently of each other, and they are operable independently. When the handle 17 is manipulated, the upper locking member is insertedly received by the guide groove 30, and the lower locking member simultaneously comes into the locking engagement with the groove **3*a* of the lower rail 3 whereby the panels constituting the folding door become unfoldable while being retained by the upper and lower rails 2, 3**.

When the lifting rod 19 is manipulated by the slider 21, it engages the additional groove 20 of the upper rail 2, lifting and rotating the supplementary guide piece plate 10 which is normally kept horizontal, and causing the guide plate 10 to stand up at a right angle as shown in Dig. 4, whereby the sealing portion 13 of the guide plate 10 is pressedly engaged against the upper outer surface of the panel 1.

In the second example shown in FIGS. 4 and 5, the supplementary guide plate 10 may be extended to the full length between the left and right jambs which comprise a front door or window opening. The supplementary guide plate 10 having such an extension can be a one piece design or may be split into a corresponding number of groups or units of panels. When the door comprises two groups with each group having two panels as shown in FIG. 5, the left and right units can be opened or shut independently of each other. Each unit can then be folded to each respective side, independently and irrespectively of the supplementary guide plate so long as it is kept horizontal. The panels may be locked by actuating the upper and lower locking members while they are kept stretched thereby allowing each unit of panels to slide along the upper and lower rails.

Further, when the right and left units are each stretched and the lifting rods 19 are projected upwardly, the horizontally kept supplementary guide 10 may be rotated counter-clockwise to have the sealing materials 15 of the sealing portion 13 abuttedly pressed against the outer surface of he door so as to seal up the door from rain and wind. It is within the scope of the present invention that the folding door may take any configuration or constructions such as is illustrated in the two groups of panels as shown in FIG. 5 or from a single unit of panels.

Since a sealing device made in accordance with the present invention has a supplementary guide piece pivotally rotatably to a side, the outside of the upper rail or the lower rail may be provided with a weight so that it is normally kept horizontal. The folding door according to the present invention can be smoothly opened an closed without being interfered with by the sealing device.

More specifically, in the first embodiment, when the locking member is actuated, the folding door is kept closed and the supplementary guide plate rotates automatically to have its sealing materials abutted against the panel surface whereby the door is sealed in an airtight, waterproof and noiseproof manner. The protrusion of the locking member operates to have it fitted into the upper and lower rails, making the panels unfoldable and unopenable and therefore not subject to rattling.

In the second embodiment where the operation of the supplementary guide plate is made by a lifting rod independent from the actuation of the above-mentioned locking member, a selective unit or units of the panels of the folding door can be folded or stretched freely and independently from other units. In addition to such advantages afforded to the sealing devices made in accordance with this second embodiment it shall be noted that even when the panels have been stretched and locked so as not to be foldable, the can freely slide along the rails without being hindered by the supplementary guide plate, since the guide plate cannot make an abutment against the panels unless the lifting rod is operated. It is also advantageous that the numerous individual units of panels constitution the door can all be folded together to one side of the door opening or divided into two groups each at one side of the frame. The provision of a lifting rod in conjunction with a locking member provides added security.

I claim:

1. A sealing device for movable panels such as doors, windows, said panels being supported by an upper and lower support rails and comprising:

a) a pivoting member extending from one of said support rails, said pivoting member has first and second ends and is rotatable between a normal horizontal position and an engaged vertical position;

b) a weighted member attached to said first end for maintaining said pivoting member in the normal horizontal position;

c) a sealing member extending from said second end, said sealing member is engageable against a side of said panels to seal the same only when said pivoting member is in the vertical position; and d) said pivoting member is only movable and maintained in the engaged vertical position by a retractable actuator means capable of applying sufficient force to move said weighted member and maintain said pivoting member in the engaged vertical position.

2. A sealing device as set forth in claim 1 and wherein:

a) said upper and lower support rails are extended above and below said panels with and sealing member extending parallel for engagement against said panels.

3. A sealing device as set forth in claim 1 and wherein:

a) said retractable actuator means comprising at least one rod member disposed in said panel and selectively protrusible therefrom and into an extended position against said weighted member with sufficient force to move said weighted member and maintain said pivoting member in the vertical position.

4. A sealing device as set forth in claim 1 and further comprising:

a) a second sealing member, said second sealing member extending from one of said support rails and engageable against an opposite side of said panel.

5. A sealing device as set forth in claim 1 and wherein:

a) said sealing member extends intermittently along one of said support rails.

6. A sealing device as set forth in claim 1 and wherein:

a) said sealing member is provided with a resilient, soft material for engagement against said panel to seal the same.

* * * * *

UNITED STATES PATENT AND TRADEMARK OFFICE

CERTIFICATE OF CORRECTION

PATENT NO. : 5,237,776

DATED : August 24, 1993

INVENTOR(S) : Kenichi Kubota

It is certified that error appears in the above-indentified patent and that said Letters Patent is hereby corrected as shown below:

On the title page, item [73], the first of the two Assignees should read: --Toko Shutter Co., Ltd.--.

Signed and Sealed this

Fifth Day of July, 1994

*Attest:*

*Attesting Officer*

BRUCE LEHMAN

*Commissioner of Patents and Trademarks*